US007568743B2

(12) United States Patent
Villagrasa et al.

(10) Patent No.: US 7,568,743 B2
(45) Date of Patent: Aug. 4, 2009

(54) HANDLE, IN PARTICULAR FOR MOTOR CAR DOORS

(75) Inventors: Victor Villagrasa, Barcelona (ES); Jose Antonio Herrero Pellicer, Castelldefels-Barcelona (ES); Natalio Ferran Viladomiu, Barcelona (ES)

(73) Assignee: Valeo Sistemas de Seguridad S.A., Oleasa de Monserrat (ES)

( * ) Notice: Subject to any disclaimer, the term of this patent is extended or adjusted under 35 U.S.C. 154(b) by 256 days.

(21) Appl. No.: 10/530,890

(22) PCT Filed: Oct. 21, 2003

(86) PCT No.: PCT/EP03/50736

§ 371 (c)(1),
(2), (4) Date: Apr. 11, 2005

(87) PCT Pub. No.: WO2004/038137

PCT Pub. Date: May 6, 2004

(65) Prior Publication Data

US 2006/0005352 A1 Jan. 12, 2006

(30) Foreign Application Priority Data

Oct. 23, 2002 (ES) ..... 200202496

(51) Int. Cl.
*E05B 3/00* (2006.01)

(52) U.S. Cl. ..... 292/336.3; 292/DIG. 31

(58) Field of Classification Search ..... 292/336.3, 292/347, 348, DIG. 31, DIG. 37; 49/360
See application file for complete search history.

(56) References Cited

U.S. PATENT DOCUMENTS

| | | | | | |
|---|---|---|---|---|---|
| 2,549,312 | A * | 4/1951 | Janonis | 292/223 |
| 2,570,160 | A * | 10/1951 | Schoch | 70/208 |
| 3,113,798 | A * | 12/1963 | Kramer | 292/336.3 |
| 3,596,955 | A * | 8/1971 | Colell | 292/336.3 |
| 4,538,844 | A * | 9/1985 | Watanabe | 292/127 |
| 4,580,821 | A * | 4/1986 | Genord et al. | 292/336.3 |
| 4,956,943 | A | 9/1990 | Yamada et al. | |
| 6,234,546 | B1 * | 5/2001 | Asakura et al. | 292/165 |
| 6,471,263 | B1 * | 10/2002 | Choo | 292/336.3 |
| 6,669,243 | B2 * | 12/2003 | Katoh et al. | 292/34 |
| 7,062,945 | B2 * | 6/2006 | Saitoh et al. | 70/278.1 |

FOREIGN PATENT DOCUMENTS

DE 3444898 C1 3/1986

* cited by examiner

*Primary Examiner*—Gary Estremsky
(74) *Attorney, Agent, or Firm*—Berenato, White & Stavish, LLC

(57) ABSTRACT

The invention concerns a handle, in particular for motor vehicle strip doors, of the type fixed in the rear frame (20) of the window of each door comprising a gripping part (1*a*) capable of being manually actuated through a groove (2), as well as means for transmission of the movement (6, 7, 9 to 13) from said gripping means (1*a*) to a lock so as to activate a bolt of said lock to open said door. The invention is characterized in that said transmission means (6, 7, 9 to 13) are arranged along a direction substantially parallel to the gripping part (1*a*), and mainly in the lower zone thereof, to optimize the longitudinal lower spade of said ear frame (20).

10 Claims, 6 Drawing Sheets

HANDLE, IN PARTICULAR FOR MOTOR CAR DOORS

The present invention concerns a handle, in particular for motor vehicle doors, of the type positioned in the rear frame of the window of each rear strip door.

The present invention also relates to an opening system for handles comprising a handle according to the invention.

BACKGROUND OF THE INVENTION

Handles for conventional rear doors of vehicles are known of the type which are coupled in the rear triangular frame of the window of each rear door, these handles comprising a gripping part that can be actuated manually by a user, via a groove, and means for transmitting the movement of said gripping part of the handle to a lock mechanism so as to activate a bolt of said lock to open said door.

The means for transmitting the movement of said handle comprise an appendage, which is integral in terms of movement with the gripping part, arranged perpendicular to the latter, and a lever which transmits the movement of said appendage to a rod of the lock mechanism to activate the bolt of said lock, said lever being, moreover, provided with elastic return means.

Said lever has two arms separated by a certain angle, the end of the upper arm being in contact with said appendage of the handle and the end of the lower arm being coupled to the abovementioned rod.

Thus, when the handle is manually actuated, the appendage turns integrally with the gripping part of the handle causing the lever to pivot, such that the lower arm of said lever lowers the rod which in turn activates the bolt of the lock to open the door.

In such handles, the transmission means, in particular the abovementioned lever, are arranged in series with respect to the gripping part of the handle, i.e. they are located behind the handle and take up more space than the gripping part alone such that, overall, the handle is of considerable size.

This problem means that the triangular zone of the rear frame of the windows of conventional rear doors has to be used to allow all the elements of said handle to be fitted.

Consequently, in particular in the rear doors known as "strip" doors, it is not possible to install these conventional handles since the inner space of the rear frame of the windows of said doors is longitudinal and very narrow.

DESCRIPTION OF THE INVENTION

The purpose of the handle, particularly for vehicle doors, of the present invention is to overcome the drawbacks associated with handles known in the art, offering a number of advantages which will be described below.

The handle concerned by the present invention comprises a gripping part that can be actuated by the user and is characterized in that said transmission means are arranged in a direction substantially parallel to the gripping part of the handle, and mainly in the lower zone thereof, so as to optimize the internal longitudinal space of said rear frame.

Thus, when the transmission means of the handle are being fitted in the lower zone thereof, said opening system can be coupled in the narrow space of the rim of the abovementioned rear frame.

The handle preferably comprises a support sheltering said gripping part of the handle and at least part of said movement transmission means.

The handle advantageously comprises a panel or mask located in the same plane as the external surface of the abovementioned rear frame, at a certain distance from the handle, so that said panel or mask conceals said handle from the outside.

By virtue of said panel or mask, the handle of each rear door remains hidden, to achieve the esthetic effect sought for a certain type of vehicle.

According to one embodiment of the present invention, the handle comprises two guide elements each located at one end of said handle, which can slide along a rail of the abovementioned support, allowing said handle to move in translation when it is actuated by the user.

The translational movement of the handle is preferably in a certain direction which maintains a small angle with respect to an axis perpendicular to the surface of said panel or mask.

Advantageously, the handle comprises, in its side zone closest to the groove for insertion of the hand, a longitudinal protective wing for covering said handle.

Said wing thus makes it possible to prevent the entry of water, ice, snow, dust, etc. which could block up the zone for movement of the handle and hinder or impede its movement.

Moreover, the abovementioned translational movement of the handle according to a certain angle prevents said wing from hitting any part of the support since, when the handle is actuated, said wing advances outward via the side part of the panel or mask.

The means for transmitting the movement of the handle preferably comprise a pivoting pin parallel to said handle, having two arms each located at one end of the latter, each arm having a shank and each shank being associated respectively with a guide element of the handle; elastic return means for said pivoting pin; and a lever which receives the movement of the arm located at the bottom and transmits it to the abovementioned rod which activates the bolt for opening said door.

Thus, actuation of the handle causes a translational movement by virtue of the displacement of the guide elements along the rail of the support. The movement of the shanks in turn causes the arms of the pivoting pin to pivot, such that the lower arm pushes the upper end of the lever, whose pivoting, lastly, lowers the rod which activates the bolt for opening the door.

The fact that two arms are used instead of one ensures that the handle works properly without deformation.

Advantageously, said lever is located in the lower zone of said handle. Thus, the space inside the abovementioned rear frame is optimized.

The end of the lever which receives the movement of the arm located at the bottom preferably has an essentially cylindrical profile.

This structural characteristic makes it possible to ensure complete transmission of the movement to the lever.

According to another embodiment of the invention, the handle has an extension in its lower part.

The means for transmitting the movement of the handle preferably comprise a pivoting pin located in a longitudinal corner of the handle, allowing said handle to pivot when it is actuated by the user; elastic return means for said pivoting pin; and a lever which receives the movement of the abovementioned lower extension of the handle and transmits it to said rod which activates the bolt for opening said door.

Thus, when it is actuated, the handle pivots about the pivoting pin, and the lower protuberance in turn pushes the upper end of the lever, whose pivoting, lastly, lowers the rod which activates the bolt for opening the door.

Advantageously, said lever is located in the lower zone of said handle. Thus, the space inside the abovementioned rear frame is optimized.

The end of the lever which receives the movement of the lower extension of the handle preferably has an essentially cylindrical profile.

This structural characteristic makes it possible to ensure complete transmission of the movement to the lever.

According to another embodiment of the invention, the handle has, at its top and bottom, substantially tubular respective shanks having a certain peripheral profile, which allow said handle to move upward and downward.

Advantageously, said upper shank integral with the handle receives the downward or upward movement via a complementary profiled part made in the support of the handle.

The means for transmitting the movement of the handle preferably comprise a pivoting pin located in a longitudinal corner of the handle, allowing said handle to pivot when it is actuated by the user; elastic return means for said pivoting pin; and a complementary shank which receives the downward or upward movement via said lower shank integral with the handle and transmits it to the abovementioned rod which activates the bolt for opening said door.

When it is actuated, the handle pivots about the pivoting pin, such that, as said handle pivots, the abovementioned profiled part causes it to move downward and, as said handle moves downward, the lower shank in turn causes the downward movement of the second complementary shank coupled to the rod which activates the bolt for opening the door.

According to another aspect of the invention, the system comprises means for fastening the support of the handle to the panel or mask.

Said fastening means preferably comprise two pairs of wings integral with said support, located respectively on each upper and lower surface of the support, said wings being mutually parallel and separated by a certain distance; and two U-shaped elements integral with the panel or mask, which are coupled respectively between each pair of wings, each pair of wings being respectively fastened to each U-shaped element using a pin or a similar component.

According to another aspect of the invention, the system comprises means for fastening the support and the panel or mask to the rim of the abovementioned rear frame of the window of each rear door.

Said fastening means preferably comprise at least two fastening elements which couple the support to the rim of the frame and at least one fastening element which retains the panel or mask on the rim of the frame.

Furthermore, advantageously, the handle according to the invention comprises a guide piece, for guiding the downward and/or upward movement of the glass pane of the door window, located on the rim of the frame of the door and to which the support of the handle is fastened.

This guide piece preferably has guide means comprising a seal at the edge of the glass pane to prevent any water from entering at the handle.

According to a particular feature of the invention, the panel or mask is applied to the guide piece to conceal the handle from the outside of the vehicle.

To hold the assembly in place, the handle comprises means for fastening the panel or mask to the guide piece and means for fastening the support of the handle to the guide piece.

The invention also relates to an opening system for a handle which incorporates such a handle.

BRIEF DESCRIPTION OF THE DRAWINGS

To facilitate the description of the above, drawings have been provided which show, schematically and only by way of non-limiting example, various possible practical embodiments of the handle and of the opening system for handles, in particular for vehicle doors, of the invention, in which.

DESCRIPTION OF THE PREFERRED EMBODIMENTS

Various preferred embodiments of a handle 1, according to the invention, are described below, this handle being of the type which is fastened to a rear frame 20 of a window of a door, in particular a rear door 30, of a motor vehicle.

Figure 1:
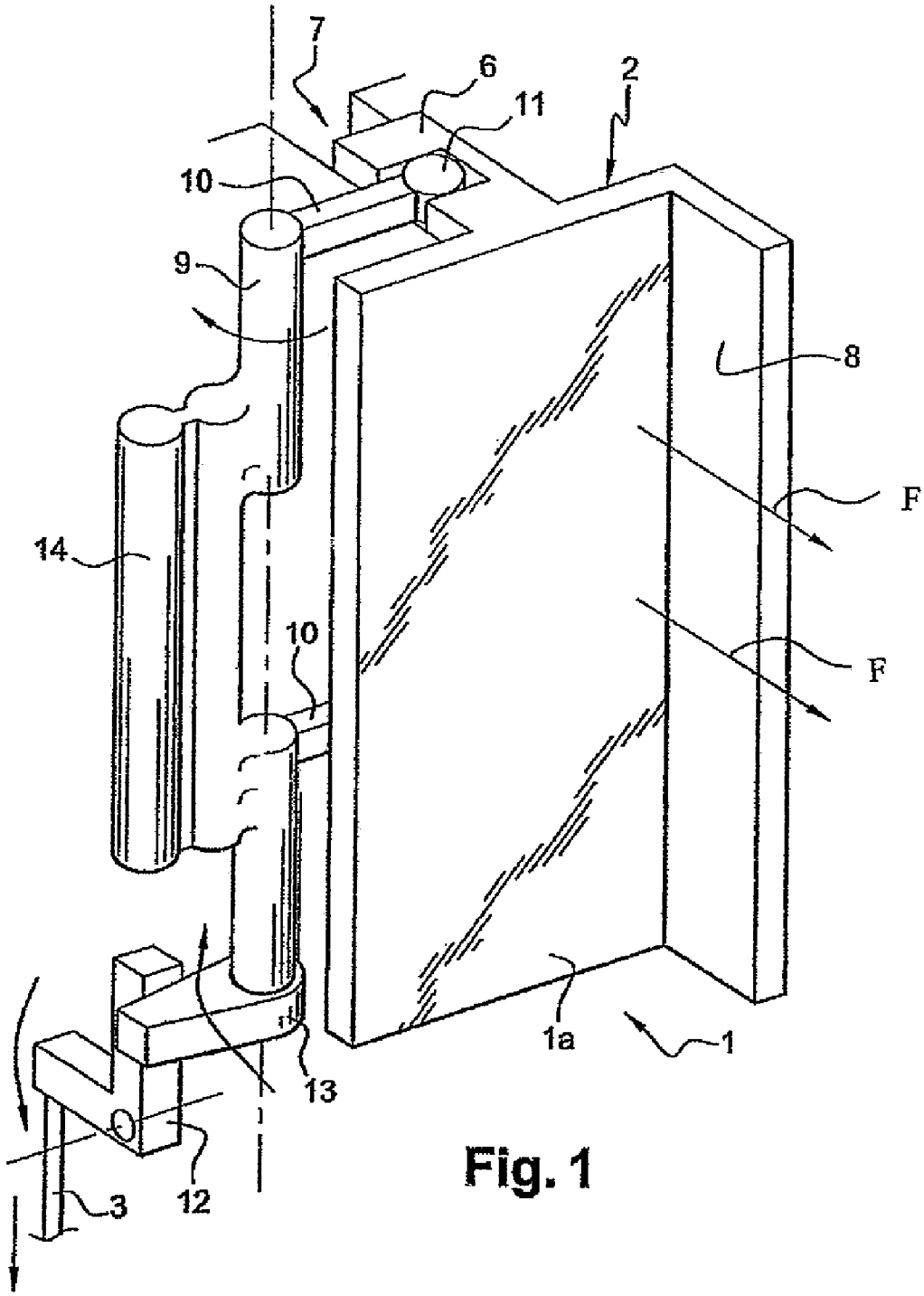
FIG. 1 is a perspective view of the handle and the movement transmission means according to a first embodiment.
Figure 2:
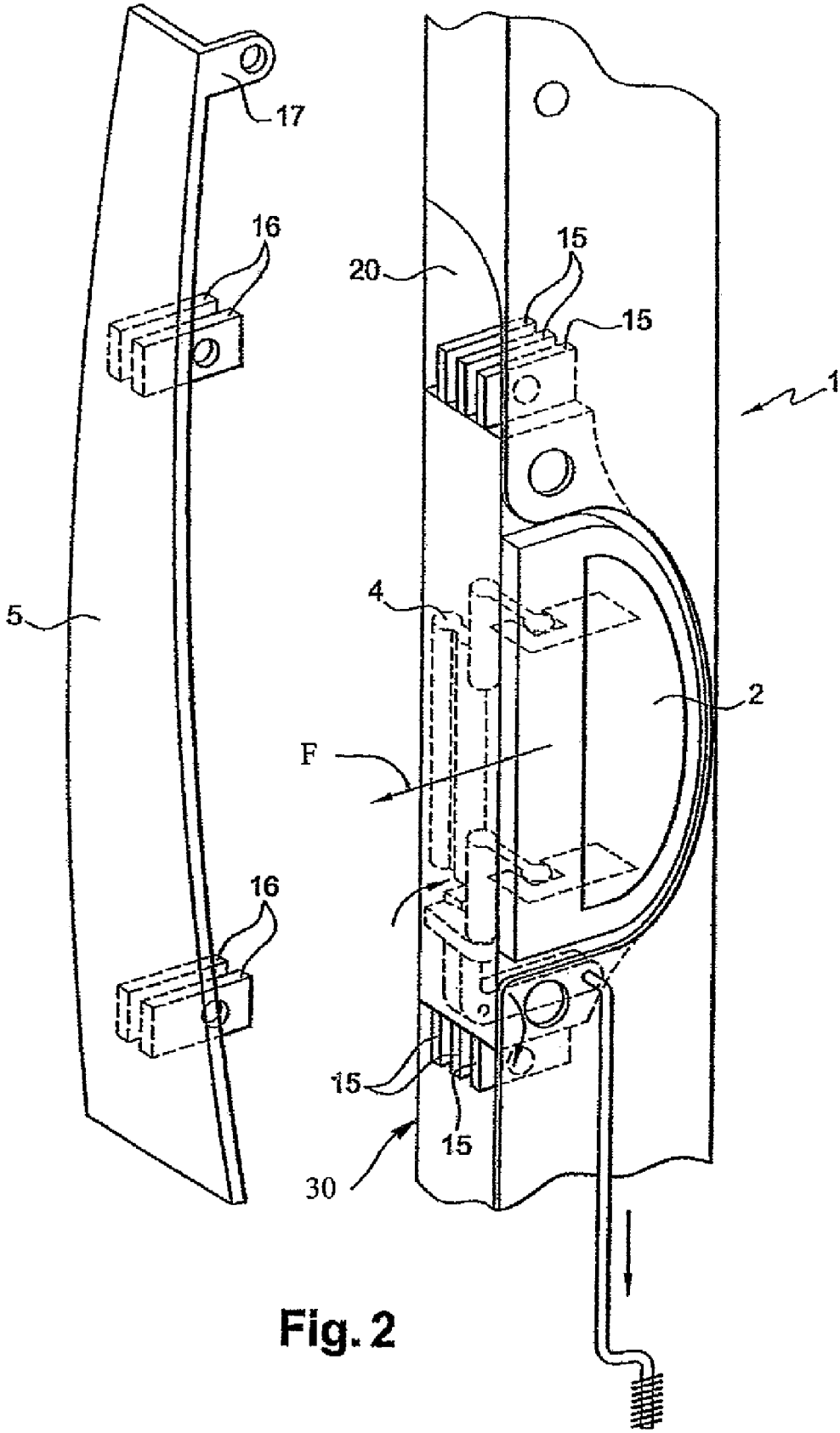
FIG. 2 is an exploded perspective view of the support and the panel or mask showing their respective fastening means.

A first embodiment of the invention is illustrated in FIGS. 1 and 2.

As shown in FIG. 1, the handle 1 comprises a gripping part 1*a* that can be actuated manually by a user, via a groove 2, and means for transmitting the movement of said gripping part 1*a* of the handle 1 to a lock mechanism, for example a rod 3 or a Bowden cable, which activates a bolt of the lock of the door to open said door.

As can be seen in FIG. 2, the handle 1 also comprises a support 4 for supporting the gripping part l*a* of the handle 1 and at least part of said movement transmission means. Moreover, the handle also comprises a panel or mask 5 located in the same plane as the external surface of the abovementioned rear frame 20 at a certain distance from the handle 1, so that said panel or mask 5 conceals said handle 1 from the outside. FIG. 2 also shows, transparently, the integration of the handle elements of FIG. 1.

As shown in FIG. 1, the handle 1 comprises two guide elements 6 each located at one end of the gripping part 1*a*, which can slide along a rail 7 of the support 4, allowing said gripping part 1*a* to move in translation when it is actuated by the user. Said translational movement of the handle 1 is in a certain direction which maintains a small angle with respect to an axis perpendicular to the surface of said panel or mask 5.

The gripping part 1*a* also comprises, in its side zone closest to the groove 2 for insertion of the hand, a longitudinal protective wing 8. Said wing 8 prevents the entry of water, ice, snow, dust, etc. which could block up the zone for movement of the handle and hinder or impede its movement.

Moreover, the abovementioned translational movement of the gripping part 1*a* according to a certain angle prevents said wing 8 from hitting any part of the support 4 since, when the handle 1 is actuated, said wing 8 advances outward via the side part of the panel or masks.

The means for transmitting the movement of the gripping part 1*a* of the handle 1 comprise a pivoting pin 9 parallel to said handle 1, having two arms 10 each located at one end of the latter, each arm 10 having a shank 11 and each shank 11 being associated respectively with a guide element 6 of the gripping part 1*a;* elastic return means (not shown) for said pivoting pin 9; and a lever 12 which receives the movement of the arm 10 located at the bottom, via an extension 13, and transmits it to the abovementioned rod 3 which activates the lock and moves the bolt for opening the lock (not shown) of said door.

The pivoting pin 9 has a counterweight 14 to prevent the handle 1 opening accidentally in the event of collision with the vehicle. This counterweight 14 thus forms the inertial mass of an inertial system built into the handle 1.

The system of this first embodiment of the invention works as follows:

Actuation of the gripping part 1*a* of the handle 1 by the user causes a translational movement thereof relative to the support 4 in the directions of arrow F (shown in FIGS. 1 and 2) by virtue of the displacement of the guide elements 6 along the rail 7 of the support 4; the movement of the shanks 11 in turn causes the arms 10 of the pivoting pin 9 to pivot, such that the lower arm 10 pushes, via its extension 13, the upper end of the lever 12, whose pivoting, lastly, lowers the rod 3 which activates the bolt of the lock for opening the door.

The handle 1 is made of a rigid material to prevent it from deforming when it is actuated, and thus ensure adequate transmission of the forces to the rest of the mechanism.

For example, the gripping part 1*a* may be made of a rigid plastic and the support 4 of zamac.

Moreover, the use of two arms 10 instead of one ensures that the handle 1 works properly without deformation of the gripping part 1*a*.

The lever 12 is located in the lower zone of the handle 1 so as to optimize the space inside the rear frame 20 of the door.

In an alternative that has not been shown, the gripping part comprises sliding elements at each guide element to facilitate the assembly of the handle and ensure good sealing of said gripping part when it is fastened to the handle support.

Moreover, as shown in FIG. 2, the system comprises means for fastening the support 4 of the handle 1 to the panel or mask 5. Said fastening means comprise wings 15, having a hole, integral with said support 4, located respectively on the upper and lower surfaces of the support, said wings 15 being mutually parallel and separated by a certain distance; and complementary wings 16, also having a hole, integral with the panel or mask 5, which engage respectively between each pair of wings 15 of the support 4, all the wings being fastened together by a pin inserted through each of the holes.

Another embodiment (not shown) of the means for fastening the support 4 of the handle 1 to the panel or mask 5 comprises two pairs of wings integral with said support 4, located respectively on each upper and lower surface of the support, said wings being mutually parallel and separated by a certain distance; and two U-shaped elements integral with the panel or mask 5, which engage respectively between each pair of wings, each pair of wings being respectively fastened to each U-shaped element using a pin or a similar component.

The system also comprises means for fastening the support 4 and the panel or mask 5 to the rim of the abovementioned rear frame 20 of the window of each rear door. Said fastening means comprise two screws that couple the support 4 to the rim of the frame 20 through each of the holes made in them; and, secondly, a screw that retains the panel or mask 5 on the rim of the frame 20 via a lug 17 having a hole, which is integral with said panel or mask 5.

Moreover, the system has sealing means, such as a cover or seal (not shown) located at the bottom of the support 4 to ensure good sealing thereof and thus prevent any water from entering it.

Figure 3:
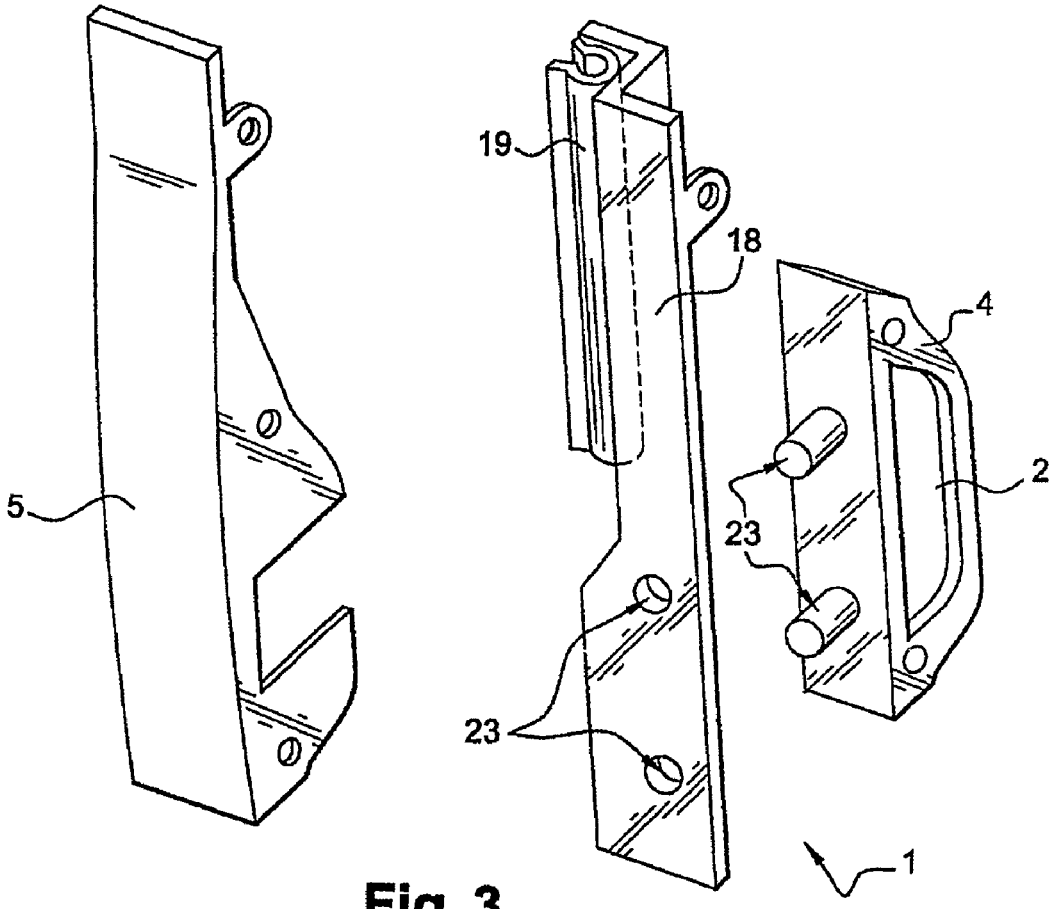
FIG. 3 is an exploded perspective view of the support, the panel or mask and the guide piece for the glass pane showing their respective fastening means.

A second embodiment of the invention is shown in FIG. 3.

In this embodiment, the handle 1 also comprises a guide piece 18 having means 19 for guiding the opening and/or closing of the glass pane of the door window. This guide piece 18 is longitudinal and has at the top a piece, also longitudinal and U-shaped, forming means 19 for guiding the glass pane (not shown) of the door window.

The guide piece 18 is located on the rim of the frame of the door and has means 23 for fastening the support 4 of the handle which is fastened to it. These fastening means 23, complementary between the guide piece and the support 4, are, for example, made in the form of a rivet fastening.

The panel or mask 5, which is an esthetic piece made of plastic, is applied to the guide piece 18 to conceal it. Likewise, fastening means (not shown) are provided for fastening the panel 5 to the guide piece 18.

The guide piece 18 is a piece generally made of metal which has, at the guide means 19, a seal, for example made of elastomer, surrounding the glass pane so as to guide it as it moves downward and/or upward and prevent water from entering at the handle, ensuring a complete seal.

Thus the guide piece 18 is arranged between the support 4 with its groove 2 for insertion of the fingers and the panel 5.

Figure 4:
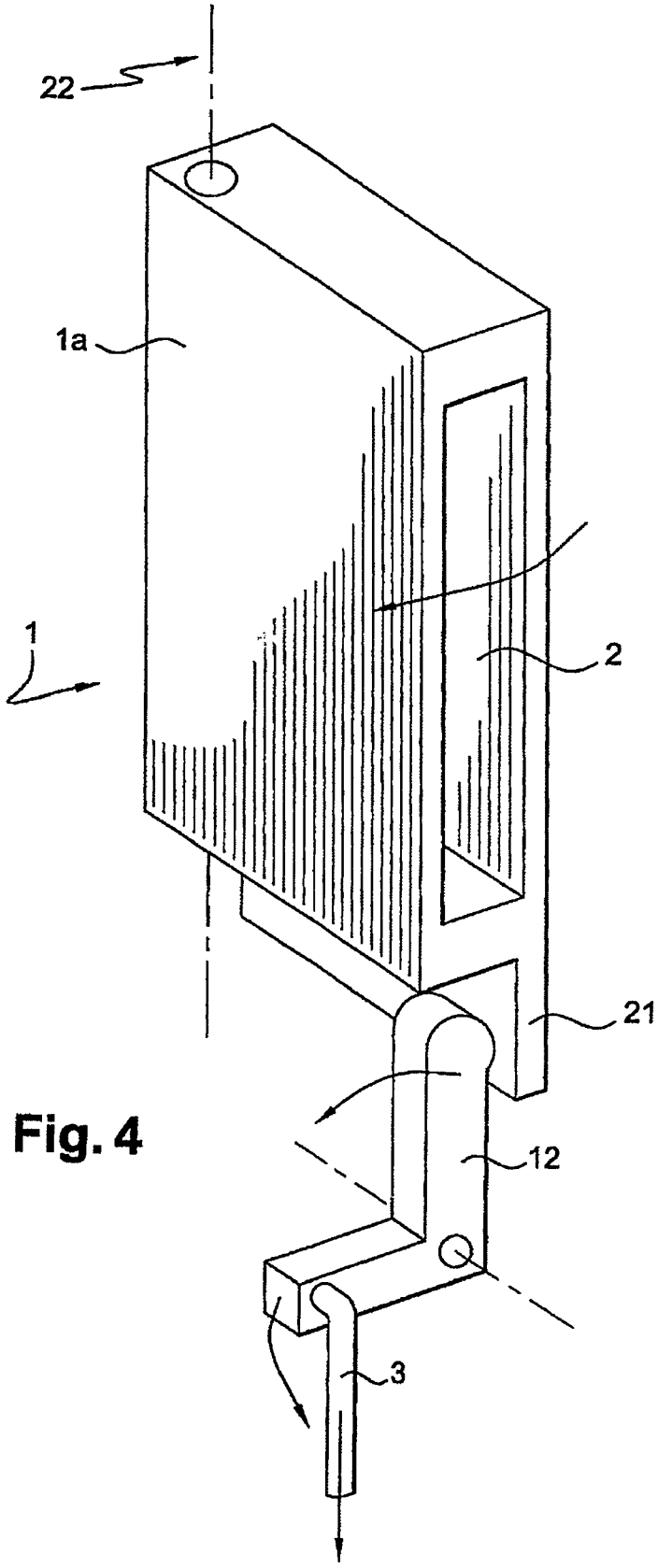
FIG. 4 is a perspective view of the handle and the movement transmission means according to a third embodiment.

FIG. 4 shows a third embodiment in which the handle 1 has an extension 21 in its lower part. The means for transmitting the movement of the handle 1*a* comprise a pivoting pin 22 located in a longitudinal corner of the gripping part 1*a*, allowing said gripping part to pivot when it is actuated by the user; elastic return means (not shown) for said pivoting pin 22; and a lever 12 which receives the movement of the lower extension 21 of the gripping part 1*a* and transmits it to the abovementioned rod 3 which activates the bolt for opening said door.

The system and the handle according to this third embodiment of the invention work as follows:

When it is actuated by the user, the gripping part 1*a* of the handle 1 pivots about the pivoting pin 22, and the lower extension 21 in turn pushes the upper end of the lever 12, whose pivoting, lastly, lowers the rod 3 which activates the bolt for opening the door.

Said lever 12 is also located in the lower zone of said gripping part so as to optimize the space inside the abovementioned rear frame 20.

In this third embodiment of the invention, the system also has a support 4 and a panel or mask 5, as well as sealing means, like the first embodiment. It can in particular be combined with the handle support 4 shown in FIGS. 2 and 3.

Figure 5:
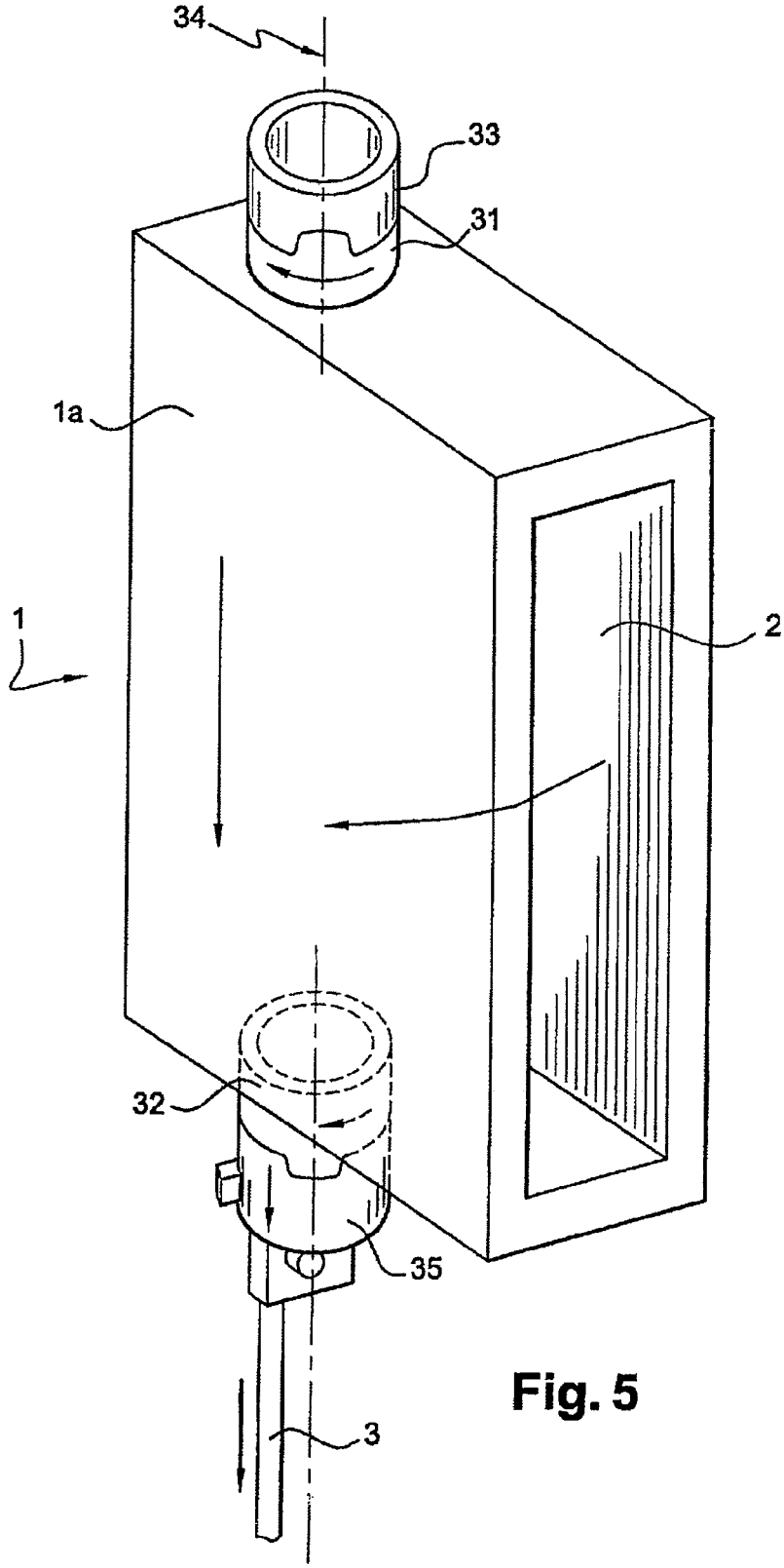
FIG. 5 is a perspective view of the handle and the movement transmission means according to a fourth embodiment.

A fourth embodiment of the invention is shown in FIG. 5.

According to this fourth embodiment, the handle 1 has, at its top and bottom, substantially tubular respective shanks 31, 32 having a certain peripheral profile, which allow the gripping part 1*a* of said handle 1 to move upward and downward.

The upper shank 31 integral with the gripping part 1*a* of the handle 1 receives the downward or upward movement via a complementary profiled part 33 made in the support of the handle 1. The means for transmitting the movement of the gripping part 1*a* comprise a pivoting pin 34 located in a longitudinal corner of said gripping part, allowing said handle 1 to pivot when it is actuated by the user; elastic return means (not shown) for said pivoting pin 34; and a complementary shank 35 which receives the downward or upward movement via said lower shank 32 integral with the gripping part 1*a* and transmits it to the rod 3 which activates the bolt for opening said door.

The handle of this fourth embodiment of the invention works as follows:

When it is actuated by the user, the gripping part 1*a* pivots about the pivoting pin 34, such that, as said gripping part pivots, the abovementioned profiled part 33 causes it to move downward and, as said gripping part moves downward, the lower shank 32 causes the downward movement of the second complementary shank 35 coupled to the rod 3 which activates the bolt for opening the door.

In this fourth embodiment of the invention, the handle 1 also has a handle support 4 and a panel or mask 5, as well as sealing means, like the first embodiment, and can be integrated in the handle support 4 shown in FIGS. 2 and 3.

Figure 6A:
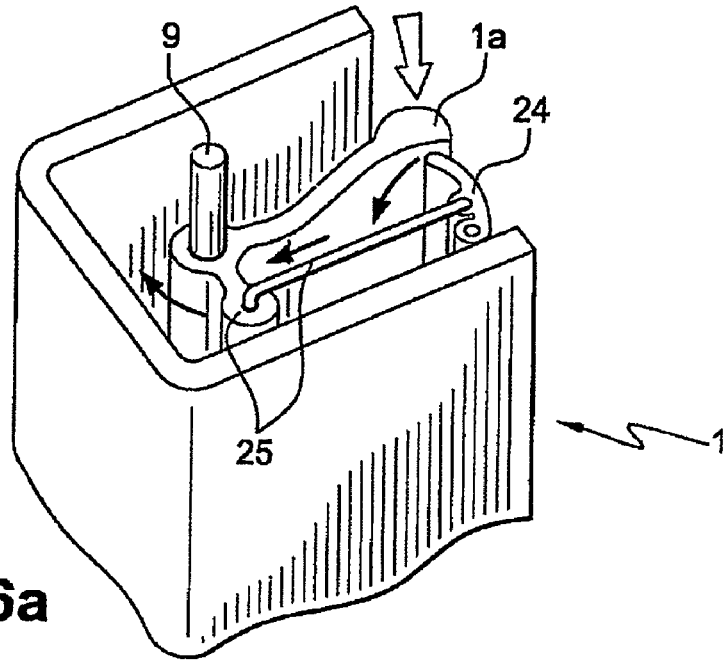
FIGS. 6*a* and 6*b* are partial perspective views, in the rest position and the use position, of the handle according to a fifth embodiment.
Figure 6B:
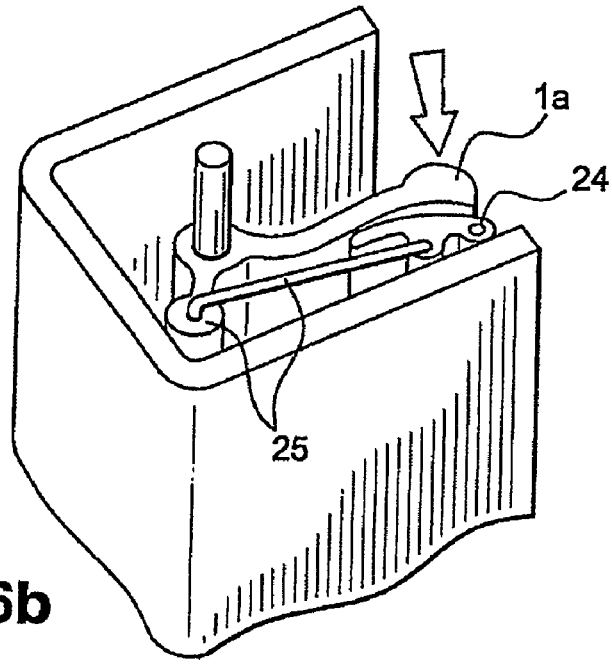

FIGS. 6*a* and 6*b* show a fifth embodiment of a handle according to the invention, in which the gripping part 1*a* is made in the form of a paddle which can be actuated by the user. In this fifth embodiment, the handle 1 has a protective element 24, independent of the gripping part 1*a*, which may take up two positions, i.e. a first position, the use position, where the handle is not actuated and in which it prevents dust, rain, etc. from entering the handle, and a second position, the retracted position, in which it is pushed in to allow the gripping part 1*a* to be actuated.

The mechanism for retracting the protective element is connected to the pivoting pin 9 and the gripping part 1*a* via levers 25.

According to an additional embodiment, not shown, it is also possible to arrange the pivoting pin of the gripping part perpendicular to the longitudinal axis of said gripping part to actuate the handle in another direction.

It is also possible to provide for the gripping part to be actuated along a curved path by modifying the guide means 6 of the first embodiment or by adjusting the pivoting pin to achieve this effect.

In the various embodiments of the invention described above, the transmission means are arranged in a direction substantially parallel to the handle, and mainly in the lower zone thereof, so as to optimize the internal longitudinal space of said rear frame.

The handle concerned by the invention is generally integrated in a complete opening system for handles which may in particular be combined with a remote control unlocking device or a "hands-free" access system.

The handle and the opening system for handles concerned by the present invention have been described in the context of an application to the rear strip doors of vehicles. They may also be applied to the front doors of a motor vehicle.

The invention claimed is:

1. A handle mounted to a rear frame (20) of a door in a motor vehicle, comprising a gripping part (1*a*) including a groove (2), and means for transmitting the movement (6, 7, 9 to 13) of said gripping part (1*a*) to a lock so as to activate a bolt of said lock to open said door, wherein said transmission means (6, 7, 9 to 13) are arranged in a direction substantially parallel to said gripping part (1*a*), and mainly in a lower zone thereof so as to optimize an internal longitudinal space of said rear frame (20);

said handle further comprising a handle support (4) fastened in said rear frame of said door and on which said gripping part (1*a*) of said handle (1) and at least part of said movement transmission means (6, 7, 9 to 13) being arranged;

said gripping part (1*a*) comprising at each of its ends a guide element (6) cooperating with said handle support (4) to allow said gripping part (1*a*) to move in translation relative to said rear frame of said door when actuated by the user.

2. The handle as claimed in claim 1, wherein the gripping part (1*a*) moves in translation when actuated by the user; the direction of said translational movement of said gripping part is oriented at an angle with respect to an axis perpendicular to the surface of the door.

3. The handle as claimed in claim 1, wherein the gripping part comprises two guide elements (6) each located at one end of the gripping element, which can slide along a rail (7) of the support (4), allowing the gripping part to move in translation when it is actuated by the user.

4. The handle as claimed in claim 3, further comprising a panel (5) located in the same plane as an external surface of said rear frame (20) at a certain distance from the handle (1) so that said panel (5) conceals said handle (1) from the outside of said vehicle, and wherein the translational movement of the gripping part (1*a*) of the handle (1), when actuated by the user, is in a certain direction oriented at an angle with respect to an axis perpendicular to the surface of said panel (5).

5. The handle as claimed in claim 1, further comprising, in a side zone thereof closest to the groove (2) for insertion of the hand, and a longitudinal protective wing (8) for covering said handle.

6. The handle as claimed in claim 1, wherein the means for transmitting the movement of the handle (1) comprise a pivoting pin (9) parallel to the gripping part (1*a*) of the handle (1), having two arms (10) each located at one end of the latter, each arm (10) having a shank (11) and each shank (11) being associated respectively with a guide element (6) of the gripping part (1*a*) of the handle (1); and a lever (12) which receives the movement of the arm (10) located at the bottom and transmits it to a rod (3) of the lock which activates the bolt for opening said door.

7. The handle as claimed in claim 6, wherein said lever (12) is located in the lower zone of said handle (1).

8. The handle as claimed in claim 1, further comprising a protective element (24) independent of the gripping part, which prevents dust or rain from entering the handle.

9. A handle mounted on a rear frame (20) of a door in a motor vehicle comprising:

a gripping part (1*a*) that can be actuated manually via a groove (2);

means for transmitting the movement (6, 7, 9 to 13) of said gripping part (1*a*) to a lock so as to activate a bolt of said lock to open said door;

a handle support (4) fastened in said frame of said door and supporting said gripping part (1*a*) of said handle (1) and at least part of said movement transmission means (6, 7, 9 to 13);

a panel (5) located in the same plane as an external surface of said rear frame (20) at a certain distance from the handle (1) so that said panel (5) conceals said handle (1) from the outside of said vehicle; and means for fastening the support (4) of the handle (1) to the panel (5);

wherein said transmission means (6, 7, 9 to 13) are arranged in a direction substantially parallel to said gripping part (1*a*), and mainly in a lower zone thereof, so as to optimize an internal longitudinal space of said rear frame (20); and wherein said fastening means comprise two pairs of wings integral with said support (4), located respectively on each upper and lower surface of the support, said wings being mutually parallel and separated by a certain distance; and two U-shaped elements integral with the panel (5), which are coupled respectively between each pair of wings, each pair of wings being respectively fastened to each U-shaped element using a pin or a similar component.

10. A handle mounted on a rear frame (20) of a door in a motor vehicle comprising:

a gripping part (1*a*) that can be actuated manually via a groove (2);

means for transmitting the movement (6, 7, 9 to 13) of said gripping part (1*a*) to a lock so as to activate a bolt of said lock to open said door;

a handle support (4) fastened in said frame of said door and supporting said gripping part (1*a*) of said handle (1) and at least part of said movement transmission means (6, 7, 9 to 13);

a panel (5) located in the same plane as an external surface of said rear frame (20) at a certain distance from the handle (1) so that said panel (5) conceals said handle (1) from the outside of said vehicle; and means for fastening the support (4) and the panel (5) to the rim of the rear frame (20) of the door, particularly the rear door, of the motor vehicle;

wherein said transmission means (6, 7, 9 to 13) are arranged in a direction substantially parallel to said gripping part (1*a*), and mainly in a lower zone thereof, so as to optimize an internal longitudinal space of said rear frame (20); and wherein said fastening means preferably comprise at least two fastening elements which couple the support (4) to the rim of the frame (20) and at least one fastening element which retains the panel (5) on the rim of the frame (20).

* * * * *